US006247210B1

(12) United States Patent
Hamilton

(10) Patent No.: US 6,247,210 B1
(45) Date of Patent: Jun. 19, 2001

(54) SLIP RESISTANT WEB ADJUSTMENT MEMBER

(75) Inventor: Jeffrey R. Hamilton, Hoffman Estates, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/489,659

(22) Filed: Jan. 24, 2000

(51) Int. Cl.[7] ..... A44B 11/00
(52) U.S. Cl. ..... 24/200; 24/198
(58) Field of Search ..... 24/198, 170, 199, 24/200, 323, 196, 316, 614–616, 265 BC, 265 EC

(56) References Cited

U.S. PATENT DOCUMENTS

| | | | | |
|---|---|---|---|---|
| 112,800 | | 3/1871 | Gathright . | |
| 165,333 | | 7/1875 | Jackson . | |
| D. 328,044 | | 7/1992 | Murai . | |
| D. 328,045 | | 7/1992 | Matoba . | |
| 462,939 | | 11/1891 | Dyer . | |
| 592,733 | * | 10/1897 | Jay | 24/323 |
| 726,404 | * | 4/1903 | Carpenters | 24/198 |
| 733,248 | | 7/1903 | Mitchell . | |
| 821,170 | | 5/1906 | Kenton . | |
| 1,822,177 | * | 9/1931 | Tenuta | 24/198 |
| 2,407,466 | * | 9/1946 | Alberts | 24/200 |
| 3,242,542 | * | 3/1966 | Tako | 24/198 X |
| 4,171,555 | | 10/1979 | Bakker . | |
| 5,222,278 | * | 6/1993 | Ball et al. | 24/198 |
| 5,551,131 | * | 9/1996 | Anscher | 24/614 |
| 5,651,166 | | 7/1997 | Lundstedt . | |

* cited by examiner

*Primary Examiner*—Robert J. Sandy
(74) *Attorney, Agent, or Firm*—Pitney, Hardin, Kipp & Szuch LLP

(57) ABSTRACT

The buckle includes a web adjustment member which further includes a first lacing bar, a second lacing bar and a third lacing bar about which webbing is laced. The first and second lacing bars are positioned relatively proximate to each other so that a pinch point is formed in the webbing proximate to the first and second lacing bars. This pinch point resists loosening of the webbing with respect to the buckle. A third lacing bar, which is relatively distant from the first and second lacing bars, maintains the pinch point during rotation of the buckle.

2 Claims, 1 Drawing Sheet

SLIP RESISTANT WEB ADJUSTMENT MEMBER

BACKGROUND OF THE INVENTION

1. Field of the Invention

This invention pertains to a web adjustment member for a two-piece buckle, which is slip-resistant and can be used in tight contours.

2. Description of the Prior Art

In the prior art, it is known to use a two-piece buckle to fasten together two lengths of webbing and to adjust the effective lengths of the webbing. However, typically the goal of providing simple adjustment of the effective lengths of the webbing, particularly adjustment by a single hand of the user, has conflicted with the goal of maintaining a fixed effective length after the adjustment has been made. Additionally, some buckles of the prior art have had difficulties in achieving the above goals when used in tight contours, particularly if the use in tight contours causes a rotation of an end portion of the buckle. An example of such a buckle is disclosed in U.S. Pat. No. 4,171,555 entitled "Buckle" and issued to Bakker et al. on Oct. 23, 1979.

Examples of somewhat similar prior art include U.S. Pat. No. 5,651,166 entitled "Method and Apparatus for Anti-Slip Webbing Adjustment" and issued on Jul. 29, 1997 to Lundstedt; U.S. Pat. No. 733,248 entitled "Buckle" and issued to Mitchell on Jul. 7, 1903; U.S. Pat. No. 165,333 entitled "Snap-Hook" and issued on Jul. 6, 1875 to Jackson; and U.S. Pat. No. Des. 328,044 entitled "Adjustable Strap Fastener" and issued on Jul. 21, 1992 to Murai.

OBJECTS AND SUMMARY OF THE INVENTION

It is therefore an object of this invention to provide a web adjustment member for a buckle which can be used to easily adjust the lengths of webbing.

It is therefore a further object of this invention to provide a web adjustment member for a buckle which maintains the adjustment of the lengths of webbing.

It is therefore a still further object of this invention to provide a web adjustment member for a buckle which can be used in tight contours, while maintaining the adjustment of the lengths of the webbing.

These and other objects are attained by providing a web adjustment member for a two-piece buckle, the two-piece buckle being of the type comprising a latch component and a body component, with the latch component detent engaging the body component in a fastened position. The web adjustment member is formed on the rear portion of the latch component and includes three lacing bars, two of the lacing bars are formed in close proximity to each other to form a pinch point while the third lacing bar is positioned so as to maintain the pinch point during any possible rotation or curvature of components of the buckle such as may occur during use in tight contours.

To tighten the buckle, the user pulls on the free end of the webbing which causes the bottom portion of the webbing to become taunt which in turn produces a pinch point at the bottom of the back bar and the free end of the webbing. Unlike many other buckles, this buckle cannot be loosened by rotating. When the rear component of the latch portion is rotated, the third lacing bar retains the pinch point between the bottom of the back bar and the free end of the webbing.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
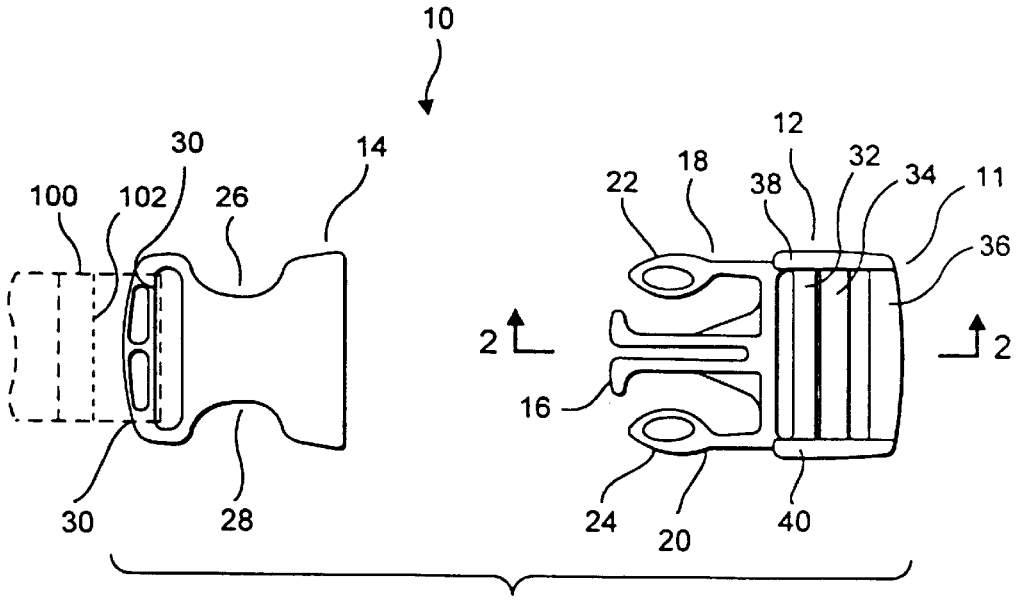
FIG. 1 is an exploded plan view of a buckle using the web adjustment member of the present invention, with the first webbing portion shown in phantom.

Referring now to the drawings in detail wherein like numerals refer to like elements throughout the several views, one sees that FIG. 1 is an exploded view of the buckle 10 showing the web adjustment member 11 of the present invention. Buckle 10 includes a latch component 12 and a body component 14. It should be understood that the details of buckle 10 shown in the figures are illustrative, and that the web adjustment member 11 can be used with many variations of buckles. In this illustrated embodiment, latch component 12 includes longitudinal guide element 16 and detent spring arms 18, 20. Longitudinal guide element 16 and detent spring arms 18, 20 are supported by internal transverse bar 21. Longitudinal guide element 16 and detent spring arms 18, 20 are engaged within the interior of body component 14 as is known in the prior art. In particular, in the latched position, distal bulbous ends 22, 24 of detent spring arms 18, 20 protrude through lateral detent apertures 26, 28 of body component 14. This allows the user to urge the protruding distal bulbous ends 22, 24 inwardly so that detent spring arms 18, 20 disengage from lateral detent apertures 26, 28 thereby unlatching latch component 12 from body component 14. Again, the above details of the engagement of latch component 12 to body component 14 are illustrative, and the web adjustment member 11 can be used with many variations of buckles.

Body component 14 includes rear web bar 30 about which the first webbing portion 100 is typically looped. First webbing portion 100 is thereafter sewn to itself along seam 102. This results in a relatively fixed position between first webbing portion 100 and body component 14.

Figure 2:
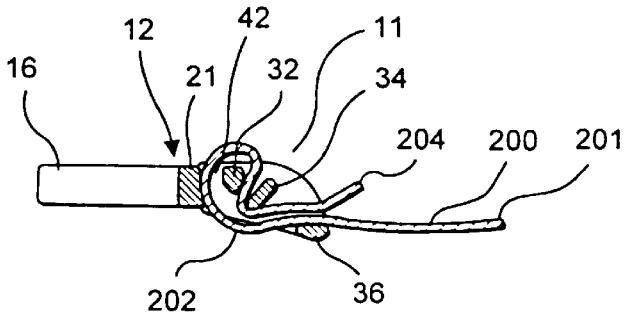
FIG. 2 is a cross-sectional view along plane 2—2 of FIG. 1 of the latch component of the buckle, showing the web adjustment member of the present invention, illustrating the path of the webbing.
Figure 3:
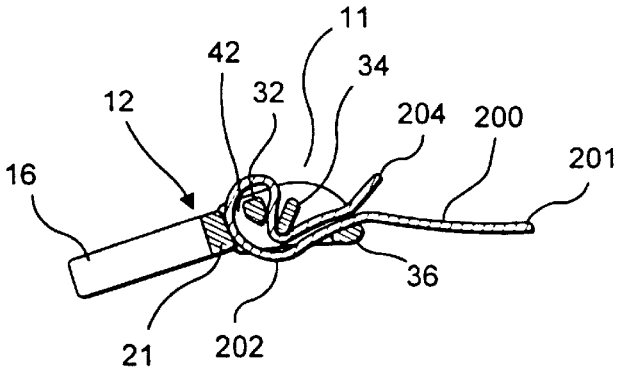
FIG. 3 is a cross-sectional view of the web adjustment member on the latch component of FIG. 2, illustrating how the third lacing bar maintains the pinch point of the web during rotation of the latch component.

Therefore, in order to provide for an adjustable length of the webbing engaged by buckle 10, second webbing portion 200 as shown in FIGS. 2 and 3 must have a relative adjustable position with respect to latch component 12. This adjustable relationship is provided by web adjustment member 11 which includes first, second and third lacing bars 32, 34, 36 which are supported by lateral structural bars 38, 40. As shown in FIGS. 2 and 3, starting from fixed end 201, second webbing portion 200 enters latching component 12 above third lacing bar 36 and passes through gap 42 formed between internal transverse bar 21 and first lacing bar 32. Second webbing portion 200 thereafter passes over first lacing bar 32 then between first lacing bar 32 and second lacing bar 34 which are spaced closely to each other with third lacing bar 36 spaced relatively distant therefrom. Second webbing portion 200 thereafter passes under second lacing bar 34 and above third lacing bar 36 to form free end 204 of second webbing portion 200. Pinch point 202 is formed in second webbing portion 200 at the bottom of second lacing bar 34 and the free end 204 of the second webbing portion 202 which, in turn, contacts and is held in position by the portion of second webbing portion 200 which passes from third lacing bar 36 to gap 42. As shown in FIG. 3, the formation of pinch point 202 is maintained by third lacing bar 36 during rotation of latch component 12 thereby maintaining the position of latch component 12 with respect to webbing portion 200. In other words, the third lacing bar 36 is positioned to allow the user to tighten up second webbing portion 200 with an easy one handed operation, but does not allow second webbing portion 200 to loosen when the latch component 12 is rotated. To tighten second webbing portion 200, the user pulls on free end 204 of second webbing portion 200, which causes the bottom portion of the second webbing portion 200 to become taunt which in turn produces pinch point 202 at the bottom of second lacing bar 34 and the free end 204 of the second webbing portion 200. When the latch component 12 is rotated, the third lacing bar 36 retains the pinch point 202 between the bottom of the second lacing bar 34 and the free end 204 of the second webbing portion 200.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A buckle including:

a first end and a second end;

one of said first end and said second end including a first lacing bar and a second lacing bar spaced relatively closely to said first lacing bar, a webbing being laced about at least a portion of said first and second lacing bars thereby forming a pinch point in the webbing, and further including a third lacing bar spaced relatively distant from said first lacing bar and said second lacing bar to maintain the pinch point during rotation of the buckle; and a body component associated with said first end and a latch component associated with said second end, said body component including a first detent element and said latch component including a second detent element for releasably detent engaging said first detent element said one of said first end and said second end includes a transverse component and a gap between said transverse component and said first lacing bar, wherein the web passes through said gap, said transverse component supports one of said first and second detent elements.

2. The buckle of claim 1 wherein the web passes from a fixed end over said third lacing bar, through said gap, over said first lacing bar, between said first and second lacing bars, under said second lacing bar and extends to a free end.

* * * * *